US006574544B1

(12) United States Patent
Yoshizawa et al.

(10) Patent No.: US 6,574,544 B1
(45) Date of Patent: Jun. 3, 2003

(54) APPARATUS AND METHOD OF VALVE TIMING CONTROL FOR INTERNAL COMBUSTION ENGINE

(75) Inventors: Hidekazu Yoshizawa, Atsugi (JP); Satoru Watanabe, Atsugi (JP); Hajime Hosoya, Atsugi (JP)

(73) Assignee: Unisia Jecs Corporation, Kanagawa-ken (JP)

( * ) Notice: Subject to any disclaimer, the term of this patent is extended or adjusted under 35 U.S.C. 154(b) by 10 days.

(21) Appl. No.: 09/698,207

(22) Filed: Oct. 30, 2000

(30) Foreign Application Priority Data

Nov. 1, 1999 (JP) ..... 11-311558

(51) Int. Cl.[7] ..... F01L 1/344; F02D 45/00
(52) U.S. Cl. ..... 701/102; 123/90.17
(58) Field of Search ..... 701/101, 102; 123/90.15, 90.16, 90.17

(56) References Cited

U.S. PATENT DOCUMENTS 6,182,636 B1 * 2/2001 Russell et al. ..... 123/399

FOREIGN PATENT DOCUMENTS

| | | | | |
|---|---|---|---|---|
| JP | 2-75001 | * | 3/1990 | ..... 700/56 |
| JP | 03-078802 A | | 4/1991 | |
| JP | 06-051839 A | | 2/1994 | |
| JP | 09-274504 A | | 10/1997 | |
| JP | 10-141022 | | 5/1998 | |
| JP | 11-002140 A | | 1/1999 | |

* cited by examiner

*Primary Examiner*—Andrew M. Dolinar
(74) *Attorney, Agent, or Firm*—Sughrue Mion, PLLC

(57) ABSTRACT

In a valve timing control apparatus for an internal combustion engine to control a rotation phase of a camshaft relative to a crankshaft so that opening and closing timing of intake and exhaust valves is variably controlled, a feedback correction amount of the rotation phase is calculated by a sliding mode control using a switching function obtained by adding a deviation between a target value and an actual value to a differential value of the deviation, to thereby feedback control using the feedback correction amount. According to this constitution, a control can be executed with high robust and with low influence due to disturbances.

16 Claims, 10 Drawing Sheets

| | sgn(S) | SMOOTHING FUNCTION(S) | SATURATION FUNCTION(S) |
|---|---|---|---|
| CALCULATION EQUATION | $\frac{S}{\lvert S\rvert}$ | $\frac{S}{\lvert S\rvert+\delta}$ | $\frac{S}{\phi}$ $\lvert S\rvert \leq \phi$<br>$\frac{S}{\lvert S\rvert}$ $\lvert S\rvert > \phi$ |

APPARATUS AND METHOD OF VALVE TIMING CONTROL FOR INTERNAL COMBUSTION ENGINE

FIELD OF THE INVENTION

The present invention relates to technology for continuously performing a variable control of rotation phase of a camshaft relative to a crankshaft for an internal combustion engine, such as an apparatus for continuously performing a variable control of opening and closing timing of intake and exhaust valves by changing rotation phase of a cam shaft relative to a crankshaft.

A conventional valve timing apparatus is known as a vane type valve timing controlling apparatus disclosed in Japanese Unexamined Patent Publication No. 10-141022.

This apparatus forms concave portions in the inner surface of a cylindrical housing fixed to a cam sprocket in which vanes of an impeller are accommodated in the concave portions wherein the camshaft rotates relative to the cam sprocket within the range where the vanes of the impeller can move in the concave portions and by relatively supplying and discharging oil into a pair of oil pressure chambers, the vanes are held in the mid position of the concave portions and thus successive changing of rotation phase can be carried out.

When oil pressure of the pair of the oil pressure chambers is adjusted to the level by which a target value of rotation phase can be obtained, a control valve closes an oil pressure passage to stop supplying and discharging oil.

PID (proportional-integral derivative) control is generally adopted as control method of the camshaft rotation phase wherein a control amount is calculated with a deviation (error amount) between an actual angle and a target angle of the camshaft as only one variable.

However, in order to carry out the PID control with a good response characteristic it is preferable that a feedback gain is set variable since viscosity of oil changes with oil temperature and oil pressure, but matching the setting as above is not easy.

In the case of oil pressure control there is wide operation dead band for a switching valve (spool valve) to switch oil supply and oil discharge and therefore dither control is executed with dither components in addition to PID to go beyond the dead band wherein judgement of addition of dither components is required to do with accuracy, bringing a complicated control and more capacity of ROM and RAM. In order to decrease variations of dead band width for each part for securing control accuracy, improvement in machining for parts is required, causing increase of machining costs.

SUMMARY OF THE INVENTION

In view of the foregoing the present invention has an object of carrying out a valve timing control with higher robust by restraining influences due to disturbances in a valve timing control apparatus for an internal combustion engine.

To achieve the above object, the present invention comprises elements as follows.

A feedback correction amount for feedback controlling a rotation phase of a camshaft relative to a crankshaft to a target value is calculated by sliding mode.

The rotation phase is feedback controlled to a target value using the calculated feedback correction amount.

With this, the opening and closing timings of intake and exhaust valves are continuously and variably controlled.

According to the constitution, based on the feedback control calculated by the sliding mode control, the control with higher robust can be carried out with less influence due to disturbances compared with a feedback control by an ordinary PID control.

The constitution may be such that a rotation phase of the camshaft is controlled by means of a switching valve which is disposed in the oil passage for selectively controlling supply and discharge of oil to an oil pressure actuator to be oil-pressure controlled.

By selectively switching supply and discharge of oil to the oil pressure actuator to be oil-pressure controlled, a driving direction of the oil pressure actuator is switched and also by adjustment of oil amount to an oil chamber, the rotation phase of the camshaft is continuously and variably controlled.

In such a constitution, by application of the sliding control to the oil pressure control mechanism, a control with high robust can be executed avoiding influences due to disturbances such as variations of a dead band of the switching valve, oil temperature, oil pressure and the like. Accordingly a machining accuracy of components can be lowered and machining costs can be reduced.

The sliding mode control may be adapted to switch a feedback gain so that a state of the control system is led to the switching line corresponding to the state of the control system.

According to this constitution, since a switch of the feedback gain is made to guide the state of the control system to the pre-set switching line, the control system can converge to a target value with a good response characteristic sliding along the switching line.

The sliding mode control may be constituted to calculate a feedback correction amount using a non-linear term calculated based on a switching function and a linear term.

With this, a sliding mode can be generated along the switching line by the non-linear term, while adjusting, by the linear term, a velocity of the state of the control system approaching the switching line.

The switching function may be calculated as a function of a deviation between a target position and an actual position of a control object.

With this, by using the deviation between the target position and the actual position for the switching function, the control amount (non-linear term) corresponding to the deviation can be given, resulting in that a complicated dither control to go beyond the dead band of the switching valve (spool valve) is not necessary and capacities of ROM and RAM can be saved. Although conventionally a matching is required for both a PID control and a dither control, it is required only for a sliding mode control and development costs and time can be reduced.

The above switching function S may be calculated by the following equation.

$$S=\gamma\times PERR+d(PERR)/dt$$

γ: inclination

PER: error amount of the control object d (PERR)/dt: differential value of the deviation between the target position and the actual position Thus since the switching function S includes the deviation (PERR) between the target value and the actual value of the control object and also the differential value d (PERR)/dt of the deviation, it is possible to make the sliding mode along the switching line more smooth.

Or, the switching function S may be calculated in the following equation.

$$S=\gamma\times PERR+d(VTCNOW)/dt$$

γ: inclination

PERR: deviation between the target position and the actual position of the control object d (VTCNOW)/dt: actual velocity of the control object Thus, even when an actual velocity is used as a differential value of the control object position, instead of the differential value of the deviation d (PERR)/dt, it is also possible to make a sliding mode control along a switching line smooth.

An inclination of the switching function is set to vary corresponding to states of the control system.

According to this constitution, by variably setting the inclination of the switching function S, a cosine component toward the origin (target value), which is formed cooperatively by the switching line and a direction to the switching line from opposite sides of the switching line (S=0), can get large according to the state of the control system, to thereby promote convergence to a target value (a target angle of VTC) and improve the response characteristic.

Other objects, features and advantages of the present invention will become more apparent from the following description of preferred embodiments when read in conjunction with the accompanying drawings.

EMBODIMENT

Figure 1:
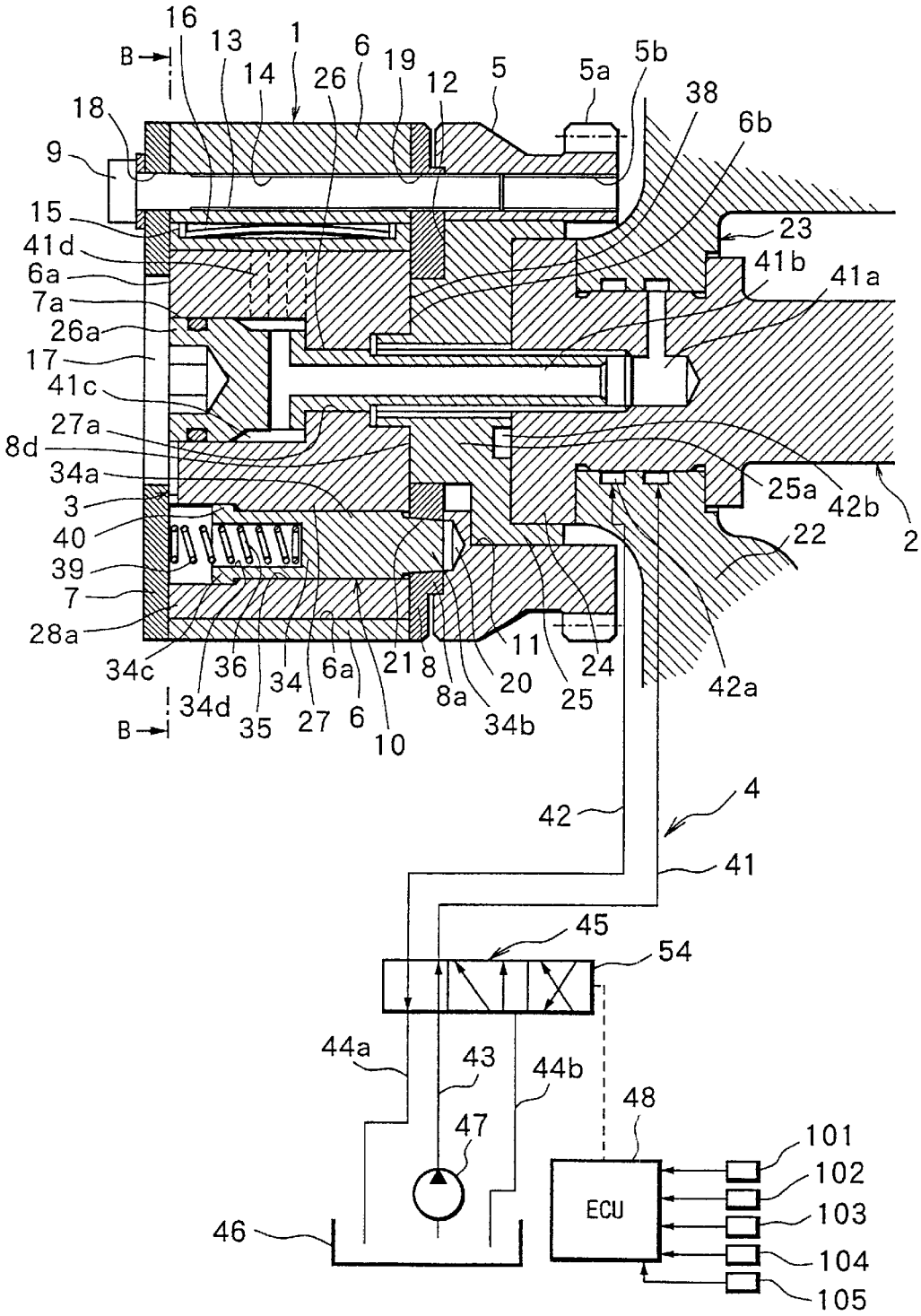
FIG. 1 is a cross sectional view of a valve timing control mechanism according to the embodiment.
Figure 2:
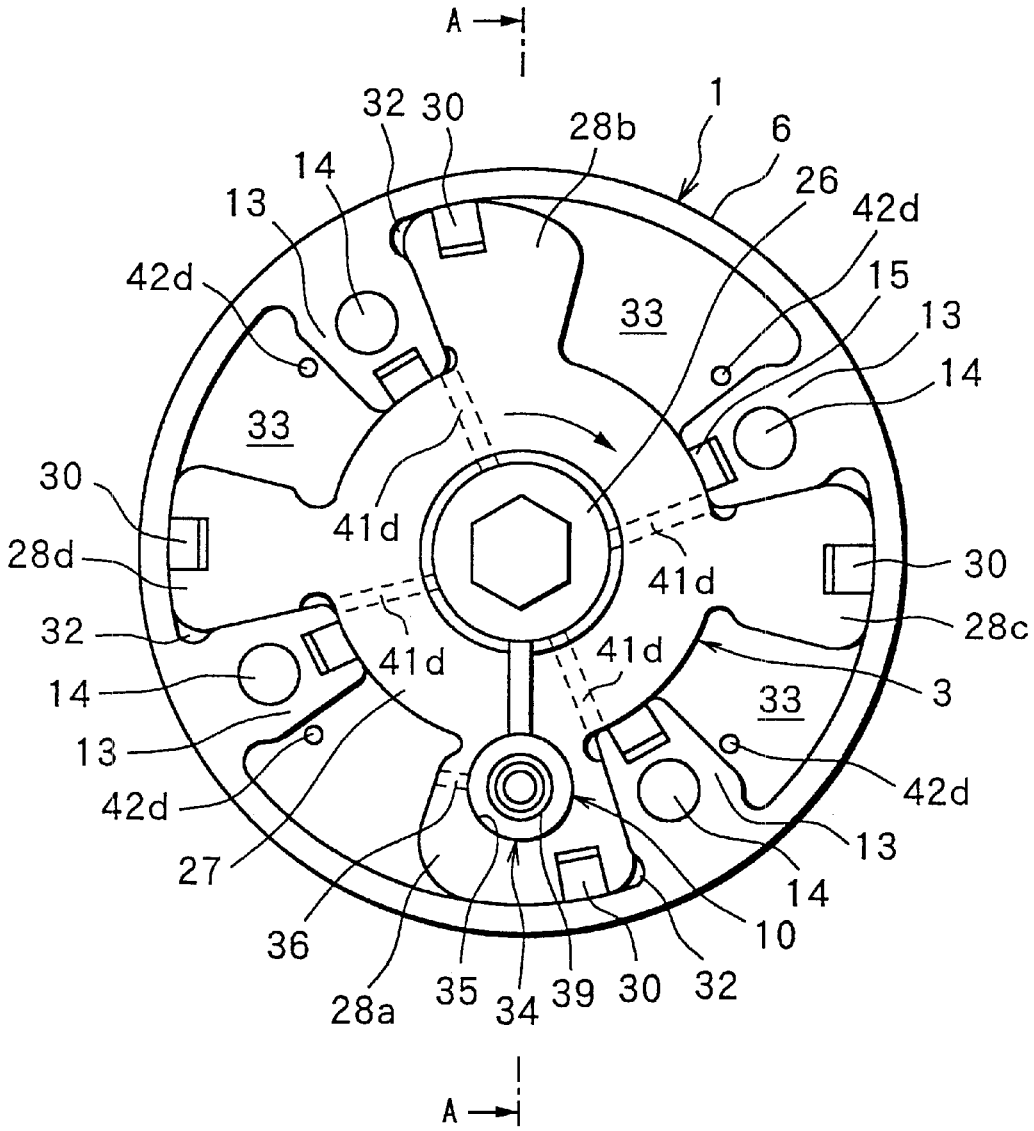
FIG. 2 is a cross sectional view taken on line B—B in FIG. 1.
Figure 3:
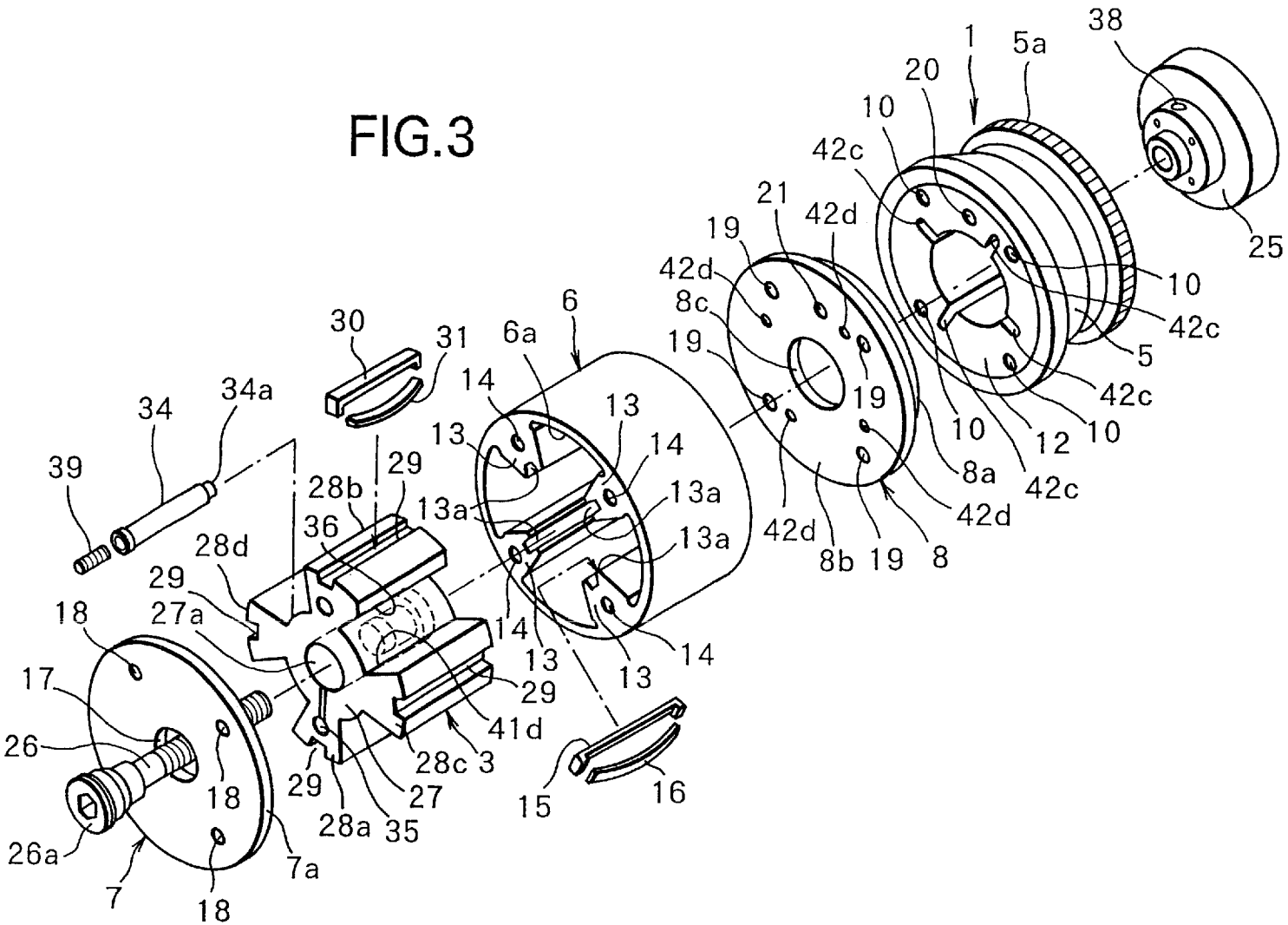
FIG. 3 is an exploded perspective view of the valve timing control mechanism.

The embodiments of the present invention will be explained as follows.

FIG. 1~FIG. 6 show mechanical portions of a valve timing control apparatus in an internal combustion engine and its application to an intake valve side.

The valve timing control apparatus as shown in the figures is equipped with a cam sprocket 1 (timing sprocket) driven to rotate through a timing chain by a crankshaft of an engine (not shown), a camshaft 2 mounted rotatably relative to the cam sprocket 1, a rotation member 3 fixed to an end of the camshaft 2 to be received rotatably in the cam sprocket 1, an oil pressure circuit 4 rotating the rotation member 3 relative to the cam sprocket 1, and a lock mechanism 10 selectively locking a relative rotation position of the cam sprocket 1 and the rotation member 3 at a predetermined position.

The cam sprocket 1 includes a rotation portion 5 having a tooth portion 5*a* on its periphery with which the timing chain (or timing belt) meshes, a housing 6 disposed in the front of the rotation portion 5 to rotatably receive the rotation member 3, a disc-shaped front cover 7 which functions as a lid for closing a front end of the housing 6 and a substantially disc-shaped rear cover 8 disposed between the housing 6 and the rotation portion 5 to close a rear end of the housing 6. The rotation portion 5 is joined integrally with the housing 6, the front cover 7, and the rear cover 8 by four small diameter bolts 9 in an axial direction.

The rotation portion 5 has a substantially annular shape in which four female screw bores 5*b* are through formed in the front-rear direction at equally spaced positions of 90 degrees in its peripheral direction and the small diameter bolts 9 are screwed to these female screw bores 5*b*, and also in the internal and central position of the rotation portion 5, a stepped fitting bore 11 is through formed into which a sleeve 25 for forming a passage to be described later is fitted. Moreover, at the front end of the rotation portion 5, a disc-shaped fitting groove 12 is formed into which the rear cover 8 is fitted.

The housing 6 has a cylindrical shape with the front and rear ends opened, and at 90 degree positions in the peripheral direction of the inner peripheral surface thereof, four partition walls 13 are formed projectingly. The partition walls 13 are formed in trapezoidal shapes in cross section and disposed along the axial direction of the housing 6 and both ends of each of the walls 13 are flush with both ends of the housing 6. At the base end side of the housing, four bolt through holes 14 are through formed in the axial direction into which the small diameter bolts 9 are inserted. Further, at the central position of the internal face of each of walls 13, a cut-out retaining groove 13*a* is formed within which C-shaped sealing member 15 and a plate spring 16 urging the sealing member 15 inwards are held fittedly.

Further, the front cover 7 is formed with a relatively large diameter bolt through hole 17 at its center and four bolt through holes at the positions corresponding to the respective bolt through holes 14 in the housing 6.

The rear cover 8 is formed with a disc portion 8*a* held fittedly within the fitting groove 12 of the rotation portion 5 at the rear end thereof, an insert hole 8*c* into which a small diameter annular portion 25*a* is inserted at the center thereof and further four bolt through holes 19 at the positions corresponding to the bolt through holes 14.

The camshaft 2 is supported rotatably through a cam bearing 23 at the tip end portion of a cylinder head 22, and at a predetermined position in the outer peripheral surface of the camshaft 2, a cam (not shown in the figures) is integrally mounted to open an intake valve through a valve lifter and a flange portion 24 is integrally mounted to its front end portion.

The rotation member 3 is fixed to the front end of the camshaft 2 through a fixing bolt 26 inserted in the axial direction through the sleeve 25 with the front and rear ends thereof fitted into the flange portion 24 and the fitting bore 11, respectively, and is equipped with an annular base portion 27 having a bolt through hole 27*a* receiving the fixing bolt 26 at the center thereof and with four vanes 28*a*, 28*b*, 28*c*, and 28*d* integrally mounted at 90 degree positions in the outer peripheral surface of the base portion 27.

Each of the first to fourth vanes (28*a*~28*d*) has a substantially inverted trapezoidal shape in cross section and disposed in the concave between each of partition walls 13 to define the front concave and the rear concave in the rotation direction. An advance pressure chamber 32 and a retard pressure chamber 33 are defined between both sides of vanes 28*a*~28*d* and both sides of partition walls. Sealing members 30 with C-shape in slide contact with an inner surface 6*a* of the housing 6 and plate springs 31 urging the sealing members 30 outwards are held and inserted in retaining grooves 29 cut-out in the axial direction at the center of the peripheral surface of each of vanes 28*a*~28*d*.

The lock mechanism 10 includes an engagement groove 20 formed at a predetermined outward position of the fitting groove 12 of the rotation portion 5, a tapered engagement bore 21 penetrated at a predetermined position of the rear cover 8 corresponding to the engagement 20, a bore 35 for slide penetrated along the internal axial direction at substantially central position of one of vanes 28 corresponding to the engagement bore 21, a lock pin 34 disposed slidably in the bore 35 of one of the vanes 28, a coil spring 39 in compressive state disposed at the rear end of the lock pin 34 and an oil pressure receiving chamber 40 formed between the lock pin 34 and the bore 35.

The lock pin 34 includes an intermediate diameter lock body 34*a* at its middle, a conical engagement portion 34*b* with its front head being smaller in diameter at the front side of the lock body 34*a* and a stepped, large diameter stopper portion formed on the rear end of the lock body 34*a*. The lock pin 34 is urged in the direction of the engagement bore 21 by the spring force of the coil spring 39 disposed in compressive state between the bottom surface of a concave groove 34*d* and an inner end surface of the front cover 7, and is slidable in the direction of it being taken out from the engagement bore 21 by the oil pressure of the oil pressure receiving chamber 40 defined between a peripheral surface between the body 34*a* and the stopper portion 34*c* and the inner surface of the bore 35 for slide. This chamber 40 is in communication with the retard oil pressure chamber 33 through a penetrating bore 36 formed in the side of the vane 28. The engagement portion 34*b* of the lock pin 34 enters into and is in engagement with the engagement bore 21 at the maximum retard rotation position.

The oil pressure circuit 4 includes a first oil pressure passage 41 which supplies and discharges oil pressure to the advance oil pressure chamber 32 and a second oil pressure passage 42 which supplies and discharges oil to the retard oil pressure chamber 33, that is two lines of the oil pressure passages. These oil pressure passages 41, 42 both are connected with a supply passage 43 and a drain passage 44 respectively through an electromagnetic switching valve 45 for passage switching. The supply passage 43 is equipped with an oil pump 47 for supplying oil in an oil pan under pressure while a downstream end of the drain passage 44 is connected with the oil pan.

The first oil pressure passage 41 includes a first passage portion 41 a formed in the cylinder head 22 and in the axis of the camshaft 2, a first oil path 41*b* which branches off in the head portion 26*a* through an axial direction of a fixing bolt 26 and communicates with the first passage portion 41*a*, an oil chamber 41*c* which is formed between a small diameter outer peripheral surface of the head portion 26*a* and an inner peripheral surface of a bolt insert hole 27*a* in the base portion 27 of the rotation member 3 to communicate with the first oil path 41*b* and four branch paths 41*d* which are formed in radial directions in the base portion 27 of the rotation member 3 to communicate with the oil chamber 41*c* and each of advance oil pressure chambers 32.

On the other hand, the second oil pressure passage 42 includes a second passage portion 42*a* in the cylinder head 22 and in an inner one side of the camshaft 2, a second oil path 42*b* which is formed in a substantially L-shape inside of the sleeve 25 to communicate with the second passage portion 42*a*, four oil passage grooves 42*c* which are formed at an outer peripheral side bore edge of the engagement bore 11 of the rotation member 5 to communicate with the second oil path 42*b* and four oil bores 42*d* which are formed at approximately 90 degree positions in a circumferential direction of the rear cover 8 to communicate each of the oil passage grooves 42*c* with the retard oil pressure chamber 33.

In the electromagnetic switching valve 45, a spool valve body of the valve 45 switches each of the oil pressure passages 41, 42 and the supply passage 43 and the drain passages 44*a*, 44*b* relatively. Further, the electromagnetic switching valve 45 is switchingly operated by a control signal from a controller 48.

Figure 4:
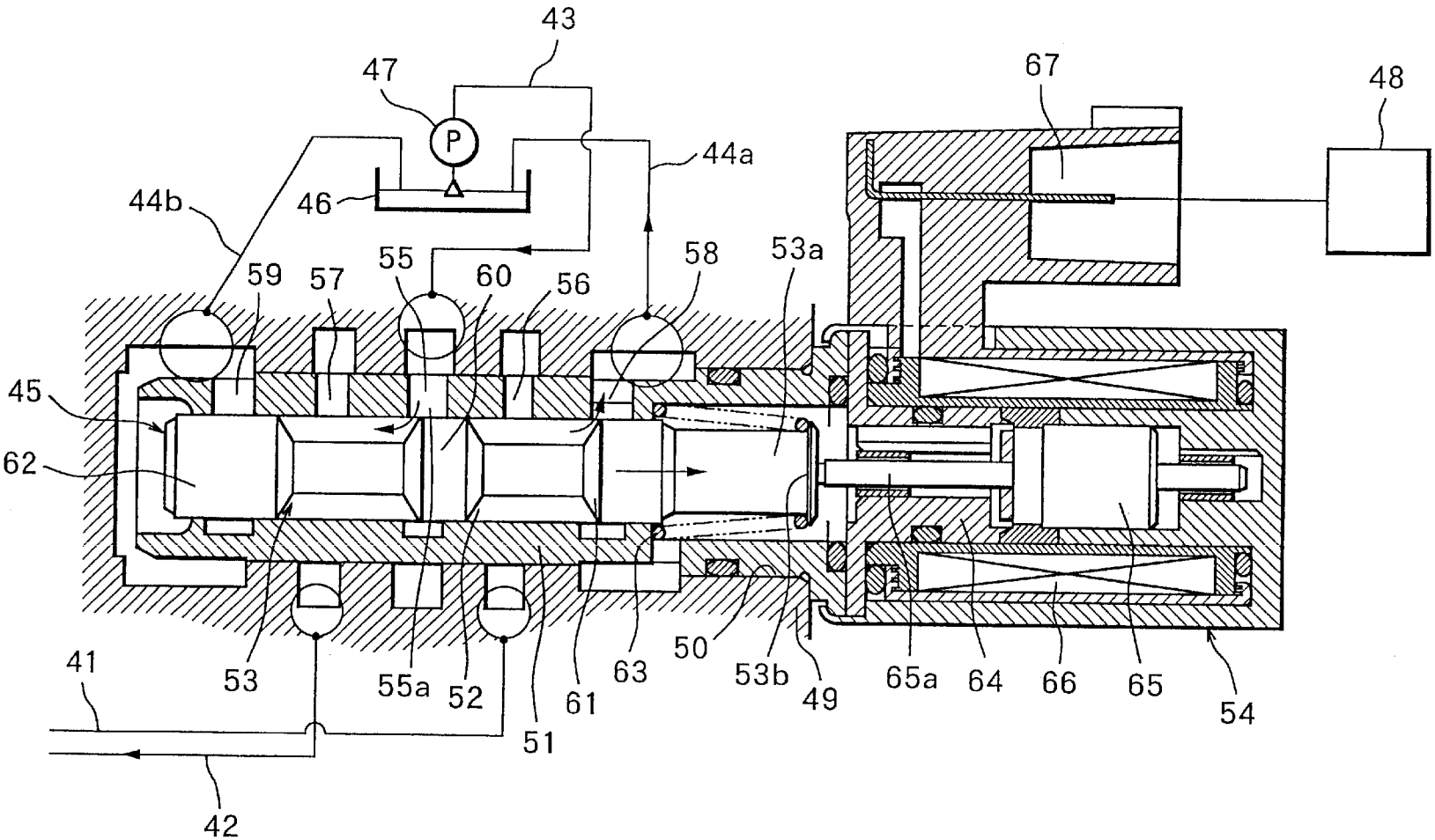
FIG. 4 is a longitudinal sectional view showing an electromagnetic switching valve in the valve timing control mechanism.
Figure 5:
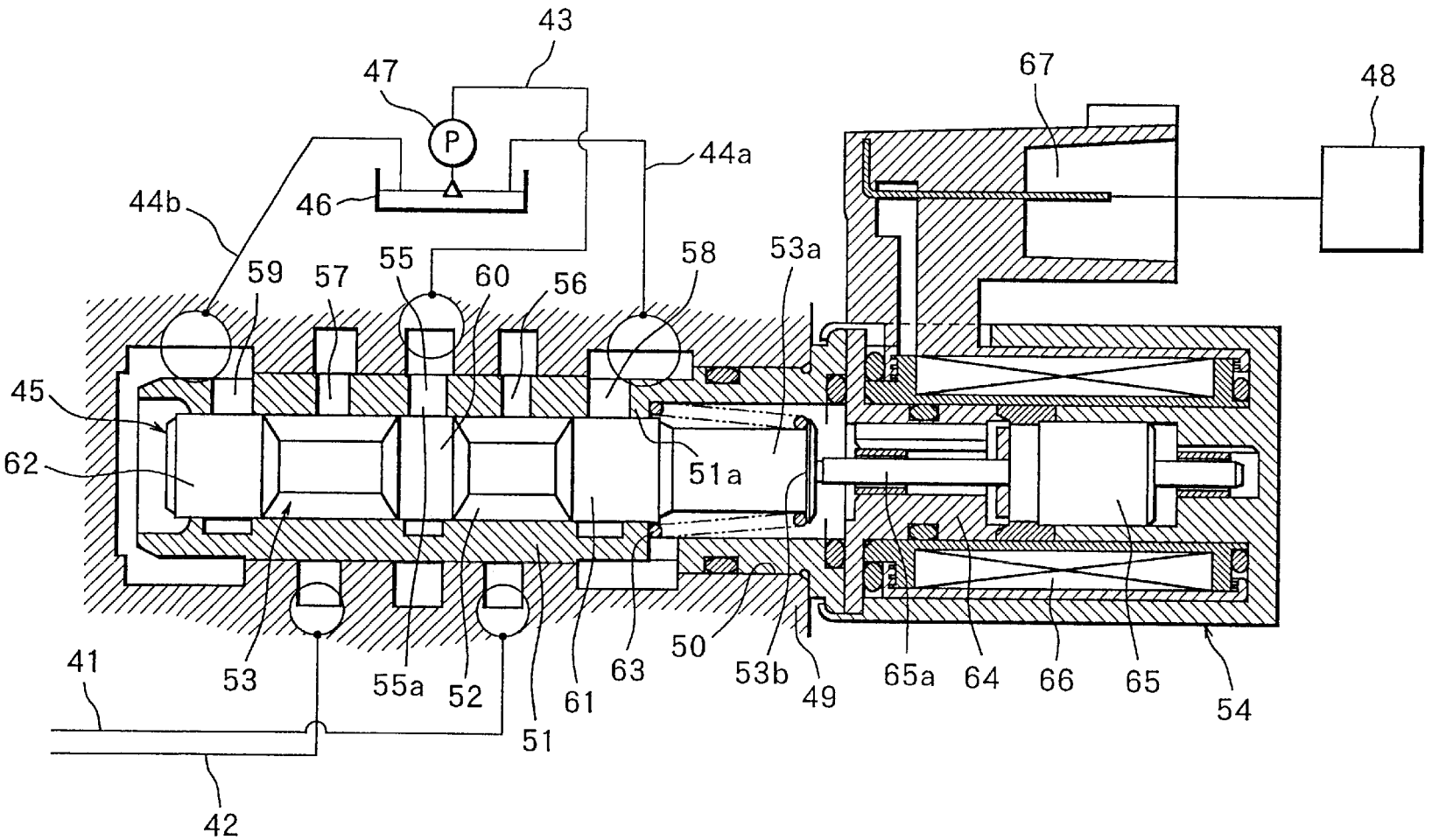
FIG. 5 is a longitudinal sectional view showing an electromagnetic switching valve in the valve timing control mechanism.
Figure 6:
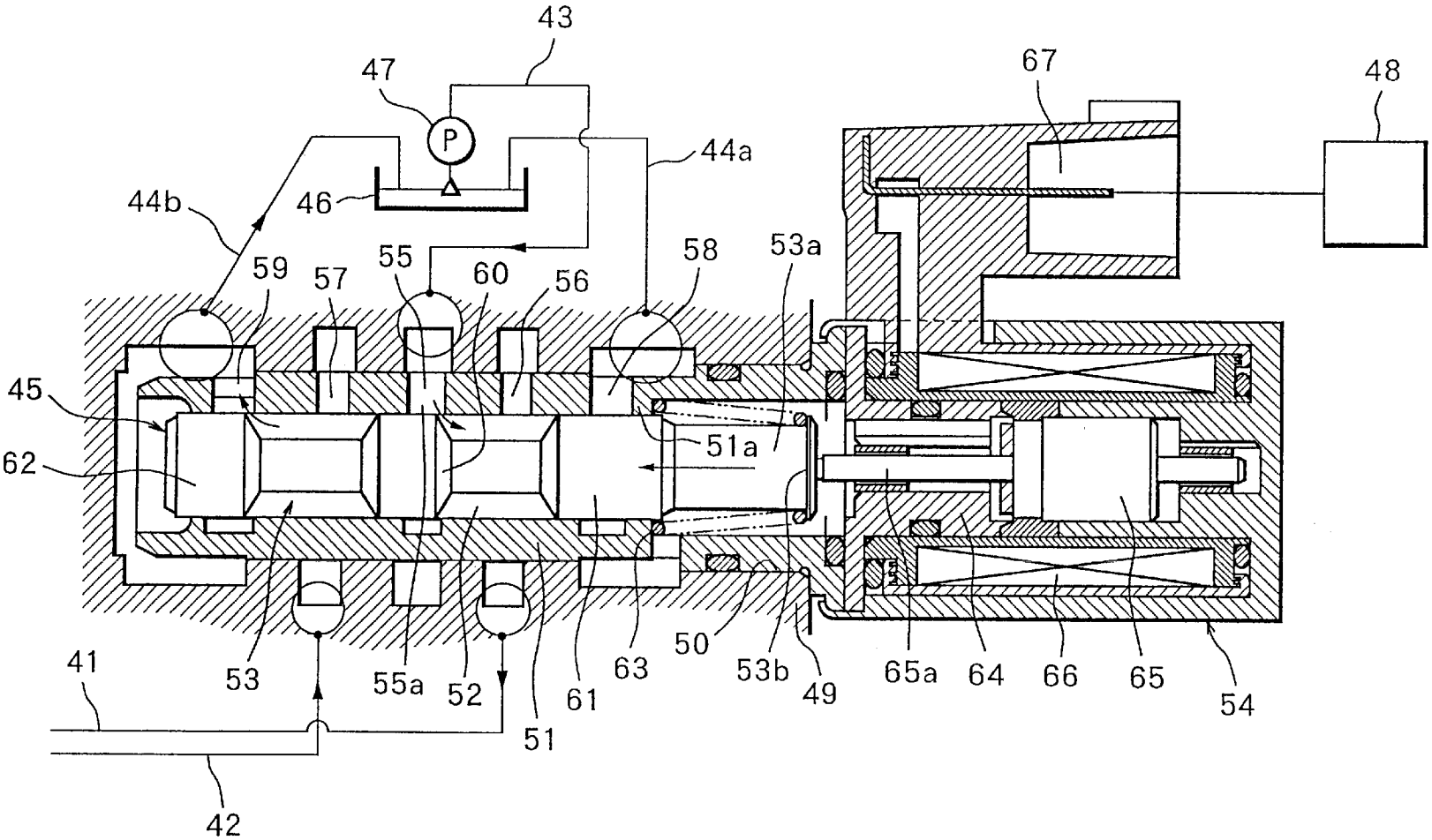
FIG. 6 is a longitudinal sectional view showing an electromagnetic switching valve in the valve timing control mechanism.

In more detail, as shown in FIG. 4 to FIG. 6, the electromagnetic switching valve includes a cylindrical body 51 inserted into and fixed to a holding bore 50 of the cylinder block 49, a spool valve body 53 which is slidable inside a valve bore 52 of the valve body 51 and switches flow path, and a proportional solenoid electromagnetic actuator 54 operating the spool valve body 53.

The valve body 51 includes a supply port 55 penetrated at the substantially central position of the peripheral wall therein which makes communication between a downstream end of the supply passage 43 and the valve bore 52, and a first port 56 and a second port 57 penetrated therein at both sides of the supply port 55 communicating other ends of the first oil pressure passage 41 and the second oil pressure passage 42 and the valve bore 52. At both ends of the peripheral wall a third port 58 and a fourth port 59 are penetrated communicating both drain passages 44*a* and 44*b* and the valve bore 52.

The spool valve body 53 includes a substantially cylindrical first valve portion 60 opening and closing the supply port 55 at the center of a small diameter axis and substantially cylindrical second, third valve portions 61, 62 at its ends therein opening and closing the third port and the fourth port 58, 59. The spool valve body 53 is urged in the right direction of the figure by a conical valve spring 63 disposed in compressive state between a cap portion 53*d* in one end of a support axis 53*a* at its front end and a spring sheet 51*a* at an inner wall of the front end of the valve bore 52 so that at the first valve portion 60 the supply port 55 and the second oil pressure passage 42 are communicated.

The electromagnetic actuator 54 is equipped with a core 64, a moving plunger 65, a coil 66, a connector 67 and the like. At the front end of the moving plunger is fixed a driving rod 65*a* pressing a cap portion 53*b* of the spool valve body 53.

The controller 48 detects present operating conditions (load, rotation) by a signal from a rotation sensor 101 detecting an engine rotation speed and by a signal from an airflow meter 102 detecting an intake air amount, and detects rotation phase of the camshaft 2 relative to the crankshaft, that is, relative position of the rotation direction of the cam sprocket 1 and the camshaft 2 by signals from the crank angle sensor 103 and the cam sensor 104.

The controller 48 controls electricity to the electromagnetic actuator 54 based on a duty control signal.

For example, when the controller 48 outputs a control signal (off signal) with a duty ratio of 0% to the electromagnetic actuator 54, the spool valve body 53 moves to the right direction at a maximum by spring force of the valve spring 63 as shown in FIG. 4. By this the first valve portion 60 opens an opening end 55*a* of the supply port 55 for communicating with the second port 57 and at the same time the second valve portion 61 opens an opening end of the third port 58 and the fourth valve portion 62 closes the fourth port 59. Therefore, operating oil pressurized from a oil pump 47 is sent to the retard oil pressure chamber 33 through the supply port 55, a valve port 52, the second port 57 and the second oil pressure passage 42 and operating oil of the advance oil pressure chamber 32 is discharged to the oil pan 46 from the first drain passage 44*a* through the first oil pressure passage 41, the first port 56, a valve bore 52, and the third port 58.

Accordingly as an inner pressure of the retard oil pressure chamber 33 is high and that of the advance oil pressure chamber 32 is low, the rotation member 3 rotates in one direction at a maximum through the vanes 28*a* to 28*d*. With this, the cam sprocket 1 and the camshaft 2 rotates one side relatively and change their phase, resulting in that an opening time of the intake valve is delayed and overlapping with the exhaust valve gets smaller.

On the other hand, when the controller 48 outputs a control signal (ON signal) with a duty ratio of 100% to the electromagnetic actuator 54, the spool valve body 53 slides in the left direction at a maximum against spring force of the valve spring 63 as shown in FIG. 6, the third valve portion 61 closes the third port 58, and at the same time the fourth valve portion 62 opens the fourth valve port 59 and the first valve port 60 communicates the supply port 55 and the first port 56. Therefore, the operating oil is supplied to the advance oil pressure chamber 32 through the supply port 55, the first port 56, and the first oil pressure passage 41. And the operating oil of the retard oil pressure chamber 33 is discharged to the oil pan 46 through the second oil pressure passage 42, the second port 57, the fourth port 59, and the second drain passage 44*b*. The oil pressure of the retard oil pressure chamber 33 gets lower.

Therefore, the rotation member 3 rotates in the other direction at a maximum through the vanes 28*a* to 28*d*, by which the cam sprocket 1 and the camshaft 2 rotate in the other side relatively and change their phase, resulting in that opening timing of an intake valve gets earlier (advanced) and overlapping with an exhaust valve gets larger.

The controller 48 makes as base duty ratio the duty ratio at the position where the first valve portion 60 closes a supply port 55, the third valve portion 61 closes the third port 58, and the fourth valve portion 62 closes the fourth port 59 and on the other hand sets a feedback correction component duty by sliding mode control to make relative position of rotation (rotation phase) between the cam sprocket 1 and the camshaft 2 detected based on signals from a crank angle sensor 103 and a cam sensor 104 to be in accordance with a target value (target advance value) of the relative position of rotation (rotation phase) set corresponding to operating conditions, and makes a final duty ratio (VTCDTY) an additional result of the base duty ratio (BASEDTY) and the feedback correction component (UDTY) and outputs control signal of the duty ratio (VTCDTY) to the electromagnetic actuator 54. In addition, the base duty ratio (BASEDTY) is set at about a central value (for example, 50%) in the duty range within which the supply port 55, the third port 58 and the fourth port 59 all close and there is no supply and no discharge of oil in both of the oil pressure chambers 32, 33.

That is, in the case the relative position of rotation (rotation phase) is required to change into the direction of retard, the duty ratio decreases by feedback correction component (UDTY), operating oil pressurized from an oil pump 47 is supplied to the retard oil pressure chamber 33, and operating oil of the advance oil pressure chamber 32 is discharged to the oil pan 46. On the other hand, in the case the relative position of rotation (rotation phase) is required to change into the direction of advance, the duty ratio increases by the feedback correction component (UDTY), operating oil is supplied to the advance oil pressure chamber 32, and operating oil of the retard oil pressure chamber 33 is discharged to the oil pan 46. In the case of holding the relative position of rotation at the then-state, with reduction of an absolute value of the feedback correction component (UDTY), the duty ratio is controlled to be back close to the base duty ratio and closing of the supply port 55, the third port 58, and the fourth port 59 (cease of supply and discharge of oil pressure) functions to hold the inner pressure of each of the oil pressure chambers 32, 33.

The feedback correction component (UDTY) will be calculated by sliding mode as follows. In the following the relative position of rotation (rotation phase) between a cam sprocket 1 and a camshaft 2 to be detected will be explained as an actual angle of a valve timing control apparatus (VTC) and its target value will be explained as a target angle of VTC.

1. Calculation of Mathematics Model

Since in sliding mode control parameters of a controller is determined based on a mathematics model of a control object, firstly the mathematics model of VTC is calculated. There are various ways to determine a mathematics model such as equations of motion and system identification. Herein is used a system identification.

Input u (k): duty,

Output y (k): actual angle of VTC

The following function is obtained by system identification.

$$G(s)=b/(s_2+a_2\cdot s+a_1)$$

2. Simplification of Transfer Function

Simplification of transfer function is carried out because a model determined by system identification may be a multiple model and constitution of a controller is to be simplified.

$$G(s)=b/\{s(s+a_2)\} \tag{2.1}$$

3. Calculation of State Equation

A differential equation of VTC by the determined transfer function is given as follows.

x: actual angle of VTC, u: input (duty)

$$\ddot{x}=-a_1-a_2\dot{x}+b\ u=f(x,\dot{x})+b\ u \tag{3.1}$$

State of Equation $$\dot{x}=A\ x+B\ u \tag{3.2}$$

An assignment of the differential equation (3.1) to (3.2) is as follows.

$$\begin{bmatrix} \dot{x} \\ \ddot{x} \end{bmatrix} = \begin{bmatrix} 0 & 1 \\ -a_1 & -a_2 \end{bmatrix} \begin{bmatrix} x \\ \dot{x} \end{bmatrix} + \begin{bmatrix} 0 \\ b \end{bmatrix} u$$

4. Designs of Switching Function

Since a sliding mode control switches a feedback gain corresponding to system conditions, this switching function is placed as follows.

$$S=\alpha_1 x+\alpha_2 \dot{x}$$

A design of a switching function is very important since there is the case that a sliding mode does not occur by parameters of the switching function. Design methods are mainly as follows.

① Design method using polar arrangement method

② Design method of optimum switching super flat plane

③ Design method using 0 point of the system

④ Design method of super flat plane by frequency rectification

By determining $\alpha_1$, $\alpha_2$ based on the above methods to obtain $\gamma$ when $\alpha_1$: $\alpha_2=\gamma:1$, the switching function S is as follows.

$$S = \left(\gamma + \frac{d}{dt}\right)x = \gamma x + \frac{dx}{dt}$$

However, as above, the switching function designed based on an ordinary textbook is function of an actual position of a control object that is an actual angle of VTC, which is not appropriate for a valve timing control apparatus as follows.

First, in the case a target angle of VTC is a value except 0 degree, $\gamma$ x always has a positive value and has no relation with a target value and an actual value. So VTC does not converge to the target angle.

When an electromagnetic switching valve in the range of the dead band, VTC does not operate. Therefore, an actual velocity dx/dt does not change . Accordingly when VTC operates by a very small angle, it does not have a good response characteristic.

In the design based on a textbook, it is preferable that integral terms of an error amount should be added. In this case when a camshaft gets a target angle, the integral term is left a value except 0, and functions to prevent convergence to the target angle.

Therefore, a switching function is set as function of an error amount as follows.

$$S = \left(\gamma + \frac{d}{dt}\right)\tilde{x} = \gamma\tilde{x} + \frac{d\tilde{x}}{dt}$$

$\gamma$: inclination $\tilde{x}$: error amount of VTC = target angle of VTC − actual angle of VTC Herein in the design of the switching function is employed a design method using 0 point of the system of ③. The 0 point of the system is a method which sets 0 point of (S, A, B) a left half surface on complex plane. (S: switching function, A, B: constant of formula (3.2))

5. Calculation of Sliding Condition

The most simple condition to establish sliding is S·d S/d t<0.

Only when S decreases, the above condition is met. Since S has an error amount and differential value of the error amount as variables, on the above condition being met, it means decrease of the errors and converge to a target value.

First the formula necessary for development of S is determined.

A control amount u is set as follows.

$$u=b^{-1}\{\hat{u}-k \text{ sgn } (S)\} \tag{5.1}$$

This is assigned to the formula (3.1).

$$\begin{aligned} \ddot{x} &= f + bb^{-1}\{\hat{u} - k\text{sgn}(S)\} \\ &= f + \hat{u} - k\text{sgn}(S) \end{aligned} \tag{5.2}$$

Next, since a hat u is developed which is an input on sliding, S=d S/d t=0.

$$\dot{S} = \left(\gamma + \frac{d}{dt}\right)\dot{\tilde{x}} = 0$$

$$\gamma \overset{\sim}{x} + \frac{d}{dt}\dot{\tilde{x}} = 0$$

$$\gamma\dot{\tilde{x}} + \ddot{x} - \ddot{x}_d = 0$$

$$\ddot{x} = \ddot{x}_d - \gamma\dot{\tilde{x}} = f + bu$$

Herein, bu=û

$$\hat{u}=-f+\ddot{x}_d-\gamma\dot{\tilde{x}} \tag{5.3}$$

The sliding condition S·d S/dt<0 is to be reviewed.

$$\begin{aligned} \dot{S} &= \left(\gamma + \frac{d}{dt}\right)\dot{\tilde{x}} \\ &= \ddot{x} - \ddot{x}_d + \gamma(\dot{x} - \dot{x}_d) \end{aligned}$$

From formulas (5.2), (5.3)

$$\begin{aligned} \ddot{S} &= f - f + \ddot{x}_d - \gamma\dot{\tilde{x}} - k\text{sgn}(S) - \ddot{x}_d + \gamma\dot{\tilde{x}} \\ &= k\text{sgn}(S) \end{aligned}$$

$$\begin{aligned} S\cdot\dot{S} &= -S\cdot k\text{sgn}(S) \\ &= -|S|k < 0 \end{aligned}$$

Accordingly, when k is made a positive value, sliding is established.

6. Design of Control Amount Calculation Formula

A control amount (feedback correction amount) u is as follows based on formulas (5.1), (5.3).

$$u=b^{-1}\{f+\ddot{x}_d-\gamma\dot{\tilde{x}}-k \text{ sgn } (S)\} \tag{6.1}$$

When formula (2.1) simplifying transfer function is used, the state of equation is as follows.

$$\ddot{x}=-a\ \ddot{x}+b\ u \tag{6.2}$$

Using the state of equation of (6.2), formula (6.1) is as follows.

$$\begin{aligned} u &= b^{-1}\{-f-\gamma\dot{x}-k\mathrm{sgn}(S) \\ &= b^{-1}\{a\dot{x}-\gamma\dot{x}-k\mathrm{sgn}(S) \\ &= b^{-1}\{(a-\gamma)\dot{x}-k\mathrm{sgn}(S) \end{aligned}$$

Herein, $\alpha=b^{-1}(a-\gamma)$, $k'=b^{-1k}$ $$u=\alpha\dot{x}-k'sgn \quad (S)$$

This formula is a formula to guarantee sliding and moving along the switching line (S=0)

However, in the control amount designed as above (as in the textbook), since there is no supply and no discharge of oil when in the dead band, operating velocity dx/dt=0→linear term=0, resulting in that the linear term will not function effectively.

Therefore, the following process is carried out so that a linear term functions effectively even on the dead band.

Namely, β·S (β is constant) is added to the formula of the above control amount u. Herein, when sliding on a switching line (s=0), β·S≈0. Then an addition of β·S to control amount u has no influence on sliding.

$$\begin{aligned} u &= \alpha\dot{x}-\beta S-k'\mathrm{sgn}(S) \\ &= \alpha\dot{x}-\beta\left(\gamma+\frac{d}{dt}\right)\dot{x}-k'\mathrm{sgn}(S) \end{aligned}$$

Herein, $\beta'=\beta\gamma,\ \alpha'=\alpha+\beta$ $$u=-\beta'\dot{x}-\alpha'\dot{x}-k'\mathrm{sgn}(S)$$

$$\underbrace{u=c\times(VTCtarget\ angle)-VTCactual\ angle)+d\times\frac{d(VTCactual\ angle)}{dt}}_{linear\ factor}\ \underbrace{-K\frac{S}{|S|}}_{non\text{-}linear\ factor}$$

Thus as a result of the above addition process, the linear term of the control amount includes an error amount (PERR) of VTC. With this, proper transfer velocity to the switching line is given by the linear term even when entering into an operation dead band and good sliding is secured on the switching line, resulting in convergence to a target angle with a good response characteristic.

Herein coefficients c and d are determined by using a design (determined by response characteristic and stability) of an ordinary linear control system. For example, coefficient c can be determined by 90% response time of an actual valve timing control apparatus and the excessive amount. Coefficient d is set to an appropriate value not to dissipate because it does not converge and generates hunching when too large.

Coefficient K is set to a positive value which is given a maximum value within a range of no hunching not to generate hunching due to being too large.

7. Design of Prevention of Chattering

As a non-linear term UnL=−k·S/|S|=−k sgn (S) is used in a digital control device, a sampling cycle can not become infinitely small, and it does not slide on a switching surface and generates chattering.

Figures 7A, 7B:
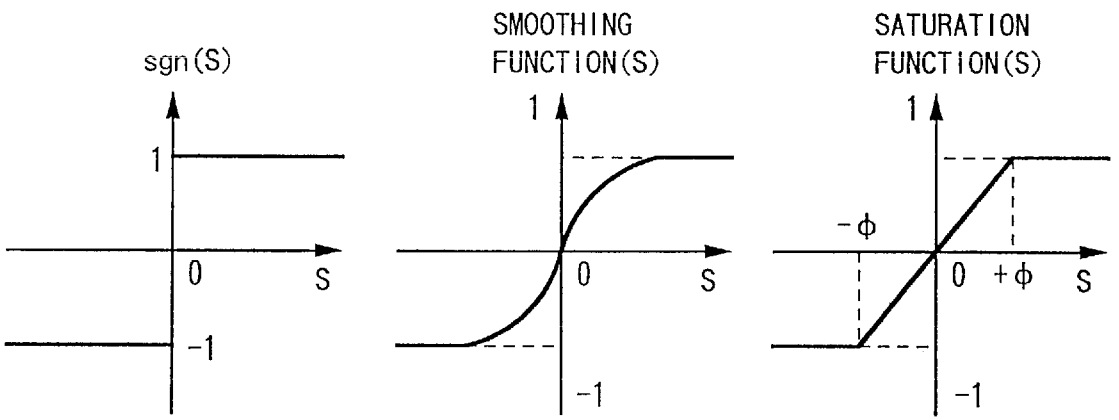
FIG. 7 is a drawing showing forms of function used for a non-linear term in a sliding mode control.

Therefore decrease of chattering is conducted by using saturation function and flat sliding function. These functions are shown in FIG. 7.

Both of them can be used, but the flat sliding function can be used easier because its calculation formula is simple compared with the saturation function.

Figure 8:
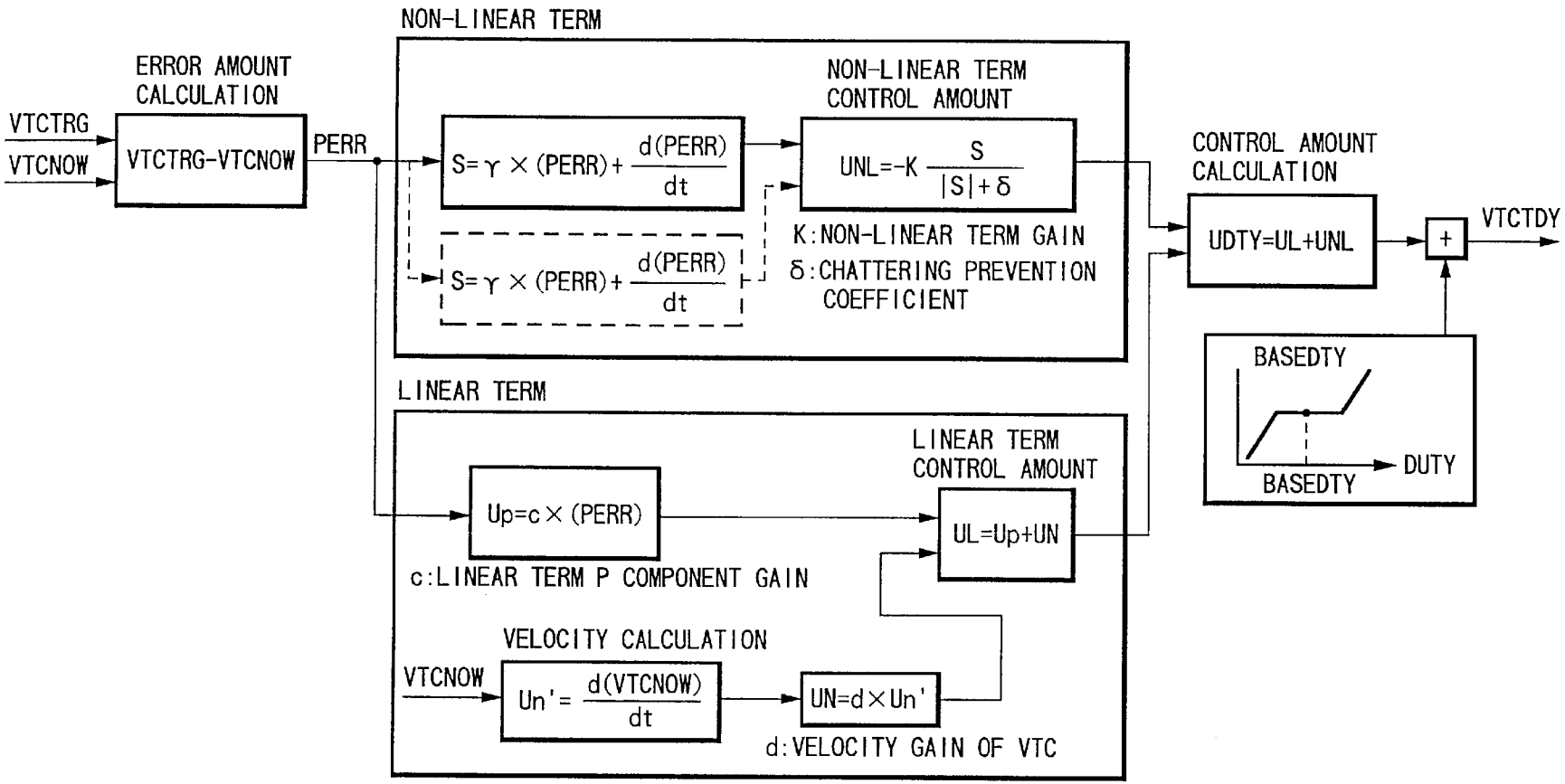
FIG. 8 is a control block diagram in the valve timing control mechanism.

FIG. 8 is a block diagram a state of a duty control of an electromagnetic actuator 54 by the controller 48 to the above designed sliding mode control is applied.

VTCTRG (target angle)−VTCNOW(actual angle)=PERR (error amount).

Up (proportional control amount)=c (proportional component gain)×PERR (error amount)

UN (velocity control amount)=d (velocity gain of VTC)×Un'(actual velocity of VTC)

UL (linear term control amount)=Up+UN

S (switching function)=PERR(error amount)×γ (inclination)+d (PERR)/dt (differential value of error amount). A non-linear term control amount UNL is calculated as a flat sliding function using the switching function S.

$$UNL=-kS(|S|+\delta)$$

The above linear term control amount UL modifies velocity of a state of a control system (VTC) coming close to a switching line (S=0). The non-linear term control amount UNL generates sliding mode along the switching line.

And a control amount UDTY (feedback correction component) is calculated by adding the linear term control amount UL and the non-linear term control amount UNL, and the calculated feedback correction component UDTY is added to a base duty ratio BASEDTY equivalent to the above dead band neutral position to be output as a final duty ratio VTCDTY.

Figure 9:
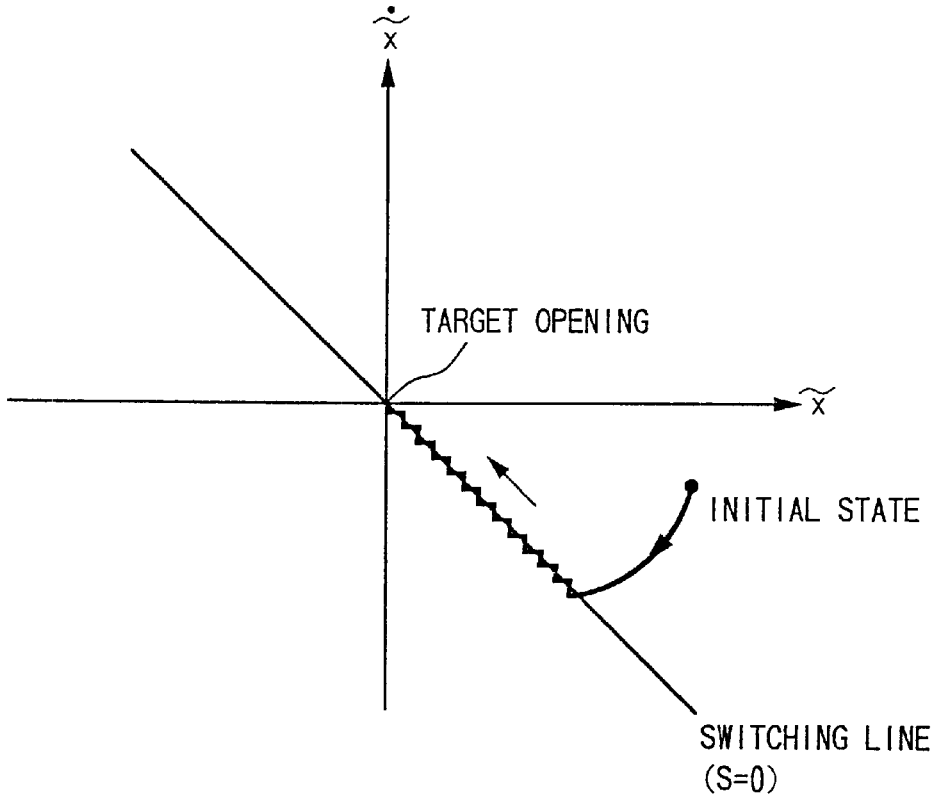
FIG. 9 is a time chart showing a state of convergence to a target angle on sliding mode control in the valve timing control mechanism.

Thus, since the feedback correction amount is calculated by sliding control so that a feedback gain is switched to lead the state of the control system on the preset switching line, the control can avoid disturbances by variations of dead band of the switching valve, oil temperature, oil pressure and the like, and with high robust can be carried out, resulting in that a machining accuracy can be lowered and machining costs can be reduced. (see FIG. 9).

In particular, since the deviation between the target angle and the actual angle can used for the switching function to obtain a control amount (non-linear term control amount) corresponding to this deviation, a complicate dither control to go beyond a dead band of a switching valve (spool valve) is not required so that capacities of ROM and RAM can be saved. Conventionally a matching has been required for both the PID control and the dither control. The invention requires only for the sliding control and therefore needs less development time and labor force.

In the above embodiment the switching function S is calculated with the differential value of the deviation. The switching function S can be calculated with the actual angle of VTC which is the differential value d (VTCNOW)/dt of the actual angle VTCNOW of VTC (shown with a dotted line in FIG. 8), instead of the differential value.

$$S=\gamma\times PERR+d(VTCNOW)/dt$$

For the inclination γ of the switching function, a good result was obtained in the experiment that the inclination γ was fixed to γ=−1. However, the inclination γ can be set to vary responsive to characteristics of the control object, provided that the value of the inclination should vary as negative so that the convergence is possible.

Figure 10:
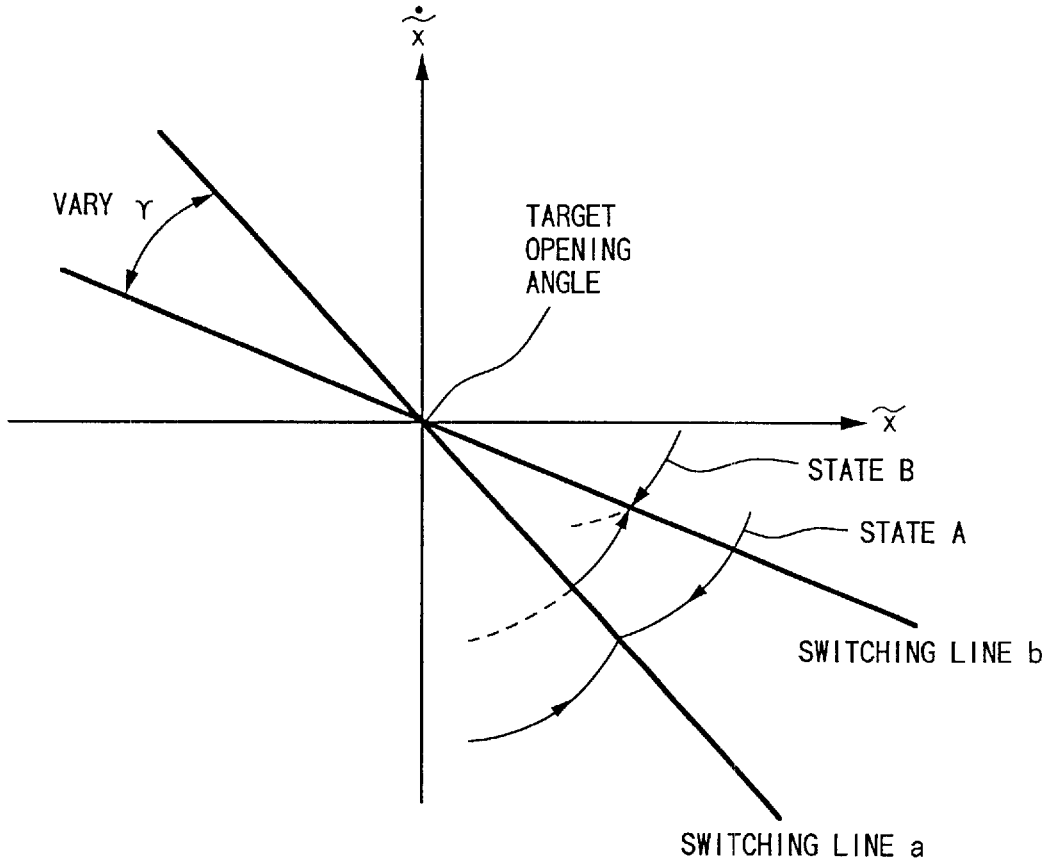
FIG. 10 is a drawing showing a state controlling to vary an inclination of a switching line corresponding to variations of a state of a control system according to another embodiment.

The control object has such characteristics that, as a result of detection of the oil temperature or the oil pressure, when the oil temperature is low and the oil viscosity is high or the oil pressure is high, the response characteristic of the control object becomes good, and when the oil temperature is high and the oil viscosity is low, or the oil pressure is low, the response characteristic of the control object becomes low. FIG. 10 shows that the inclination γ is set to vary according to the above response characteristic. In this way, by variably setting the inclination γ of the switching function S, a cosine component toward the origin (target value), which is formed cooperatively by the switching line and a direction to the switching line from opposite sides of the switching line (S=0), can get large according to the state of the control system, to thereby promote convergence to the target value (the target angle of VTC) and improve the response. Namely, in FIG. 10, in the case that the state of the control system is A, the cosine component becomes larger when the switching line a with a small inclination |γ| is used, compared to when the switching line b with a large inclination |γ| is used. In the case that the state of the control system is B, the cosine component becomes larger when the switching line b with a large inclination |γ| is used, compared to when the switching line a with a small inclination |γ| is used. In both A and B, good response characteristics can be obtained, respectively.

The present invention is not limited to a VTC using the vane type oil pressure actuator but, as a matter of course, can be applied to a VTC which varies rotation phase of the cam shaft by converting a linear movement into a rotation movement using a linear type oil pressure actuator, and further, the present invention is not limited to an oil pressure control type.

The entire contents of Japanese Patent Application No. 11-311558, filed on Nov. 1, 1999, is incorporated herein by reference.

What is claimed:

1. A valve timing control apparatus for an internal combustion engine comprising:

a crankshaft;

a camshaft connected to said crankshaft;

an intake valve driven by said camshaft; and an exhaust valve driven by said camshaft, wherein a rotation phase of said camshaft relative to said crankshaft is feedback controlled to a target value based on a feedback correction amount calculated by a sliding mode control so that opening and closing timing of said intake and exhaust valves are continuously and variably controlled.

2. A valve timing control apparatus for an internal combustion engine according to claim 1, wherein said rotation phase of said camshaft is controlled by means of a switching valve which is disposed in an oil passage for selectively controlling supply and discharge of oil to an oil pressure actuator to be oil-pressure controlled.

3. A valve timing control apparatus for an internal combustion engine according to claim 1, wherein said sliding mode control switches a feedback gain to guide a state of a control system to a switching line corresponding to the state of said control system.

4. A valve timing control apparatus for an internal combustion engine according to claim 1, wherein said feedback correction amount calculated by said sliding mode control includes a non-linear term calculated based on a switching function and a linear term.

5. A valve timing control apparatus for an internal combustion engine according to claim 3, wherein said switching function is calculated as a function of a deviation between a target position and an actual position of a control object.

6. A valve timing control apparatus for an internal combustion engine according to claim 5, wherein said switching function is calculated by the following equation:

$$S=\gamma\times PERR+d(PERR)/dt$$

γ: inclination

PERR: the deviation between the target position and the actual position of said control object.

7. A valve timing control apparatus for an internal combustion engine according to claim 5, wherein said switching function is calculated by the following equation:

$$S=\gamma\times PERR+d(VTCNOW)/dt$$

γ: inclination

PERR: the deviation between the target position and the actual position of said control object d (VTCNOW)/dt: an actual velocity of said control object.

8. A valve timing control apparatus for an internal combustion engine according to claim 3, wherein an inclination of said switching function is set to vary according to a state of said control system.

9. A method of a valve timing control for an internal combustion engine comprising the steps of:

calculating, by a sliding mode control, a feedback correction amount for feedback controlling a rotation phase of a camshaft relative to a crankshaft, to a target value, feedback controlling said rotation phase using said calculated feedback correction amount, and continuously and variably controlling opening and closing of intake and exhaust valves driven by said camshaft the rotation phase of which is controlled to the target value.

10. A method of a valve timing control for an internal combustion engine according to claim 9, wherein said rotation phase of said camshaft is controlled by selectively controlling supply and discharge of oil to an oil pressure actuator to be oil-pressure controlled by means of a switching valve disposed in an oil passage.

11. A method of a valve timing control for an internal combustion engine according to claim 9, wherein said sliding mode control switches a feedback gain to guide a state of a control system to a switching line corresponding to the state of said control system.

12. A method of a valve timing control for an internal combustion engine according to claim 9, wherein said feedback correction amount is calculated by said sliding mode control using a non-linear term calculated based on a switching function and a linear term.

13. A method of a valve timing control for an internal combustion engine according to claim 11, wherein said switching function is calculated as a function of a deviation between a target position and an actual position of a control object.

14. A method of a valve timing control for an internal combustion engine according to claim 13, wherein said switching function is calculated by the following equation:

$$S=\gamma\times PERR+d(PERR)/dt$$

γ: inclination

PERR: the deviation between the target position and the actual position of said control object.

15. A method of a valve timing control for an internal combustion engine according to claim 13, wherein said switching function is calculated by the following equation:

$$S=\gamma\times PERR+d(VTCNOW)/dt$$

γ: inclination

PERR: the deviation between the target position and the actual position of said control object d (VTCNOW)/dt: an actual velocity of said control object.

16. A method of a valve timing control for an internal combustion engine according to claim 11, wherein an inclination of said switching function is set to vary according to a state of the control system.

* * * * *